United States Patent [19]

Silks et al.

[11] 4,436,345

[45] Mar. 13, 1984

[54] CONTINUOUS MINING MACHINE HAVING CONTOUR CUTTERS

[75] Inventors: Walter Silks, Downers Grove; Joseph Gonski, Oak Lawn, both of Ill.

[73] Assignee: Goodman Equipment Corporation, Chicago, Ill.

[21] Appl. No.: 296,497

[22] Filed: Aug. 26, 1981

[51] Int. Cl.[3] ..... E21C 27/24

[52] U.S. Cl. ..... 299/59; 299/86

[58] Field of Search ..... 299/57–60, 299/85, 86, 90; 175/91, 388

[56] References Cited

U.S. PATENT DOCUMENTS

| | | | |
|---|---|---|---|
| 556,985 | 3/1896 | Hurd | 299/60 X |
| 3,108,788 | 10/1963 | Allimann | 299/57 |
| 3,331,636 | 7/1967 | Karlovsky et al. | 175/91 X |
| 3,523,711 | 8/1970 | McCleery | 299/59 |
| 3,640,573 | 2/1972 | Safer | 299/90 X |
| 4,303,277 | 12/1981 | Roepke et al. | 299/86 X |

*Primary Examiner*—Ernest R. Purser

*Attorney, Agent, or Firm*—Fitch, Even, Tabin & Flannery

[57] ABSTRACT

A boring type continuous mining machine having a plurality of boring heads each of which is adapted to cut a substantially rectangular profile bore in the mine face. Each boring head includes a primary cutter head and at least one contour cutter rotatable with the primary cutter and also about an axis spaced from and parallel to the rotational axis of the primary cutter. Each contour cutter carries eccentric cutter teeth which cut selective profile areas radially outwardly and intersecting the bore cut by the associated primary cutter head. The boring heads are supported on the mining machine frame in a manner allowing independent drive of the boring heads and isolating thrust loads from the boring head drive trains.

32 Claims, 4 Drawing Figures

CONTINUOUS MINING MACHINE HAVING CONTOUR CUTTERS

BACKGROUND OF THE INVENTION

The present invention relates generally to continuous mining machines of the boring type, and more particularly to a continuous mining machine having novel contour cutters and support structure therefor which enable cutting of a substantially rectangular shaped bore hole in a mine face and which isolate thrust loads on the boring heads so that such loads act directly on the primary frame of the machine.

Continuous mining machines of the boring type employing one or more boring heads which are rotated as the machine is advanced toward the face of a seam being mined are generally known, particularly in mining coal and other materials such as potash, salt, gypsum and the like. Use of a single rotating boring head having a relatively fixed cutting diameter results in a circular bore contour requiring trimming to form a substantially rectangular contour necessary for adequate ventilation space at the corners and to provide a relatively flat floor surface to accommodate tramming of the mining machine. Similarly, boring type mining machines employing multiple boring heads each of which is adapted to cut a generally circular profile bore, while able to cut a substantially wider bore hole, also generally require trim bars and chains to cut the corners and cusps which project upwardly from the floor and downwardly from the roof of the mine between adjacent boring heads. See, for example, U.S. Pat. No. 3,088,719.

The problem of cusp removal can be alleviated to some extent by staggering the boring heads longitudinally relative to the machine frame so that the axes of the boring heads can be spaced closer together than possible when the cutter faces of the boring heads are generally coplanar. See, for example, U.S. Pat. No. 3,290,094. The mining machine disclosed in U.S. Pat. No. 3,290,094 has a pair of generally coplanar inner boring heads which require rotational coordination to prevent physical interference therebetween. Trim bars and trim chains are still required to cut the cusps and corners, even though the cusps may be smaller because of closer spacing of the boring heads. The trim chains may also assist in moving the cuttings to a position generally central to the machine for conveying the cuttings longitudinally rearward of the machine for discharge.

In an effort to eliminate the need for trim bars and trim chains in forming substantially rectangular shaped or contoured bore holes, boring or cutter heads in the form of rotating arms have been developed in which the arms during rotation are caused to follow a path of such configuration that the projection of the path on a plane transverse to the longitudinal axis of the machine is substantially in the form of a square. By the proper spacing and rotational coordination of two such boring heads, termed contour cutters, the formation of upper and lower cusps between the boring heads is substantially reduced. See, for example, U.S. Pat. No. 2,825,544.

A more recent boring head design for boring type continuous mining machines is disclosed in U.S. Pat. No. 3,407,006 and employs a pair of primary boring heads which are adapted to cut circular bores in the working face of a mine, followed by contour cutters which are cooperative with the primary boring heads such that the contour cutters rotate about the rotational axes of the associated primary boring heads. The contour cutter assemblies have cam followers which cooperate with a cam groove to effect translational movement of the contour cutters relative to their associated primary boring heads so that the contour cutters cut radially beyond the reach of the primary boring heads and form generally rectangular bore contours.

While contour boring heads as disclosed in aforementioned U.S. Pat. No. 3,407,006 have proven acceptable for their intended purpose of forming generally rectangular contour shaped bore holes, they employ relatively complex mechanisms for radially extending and retracting supplemental contour cutters during rotation of the primary cutters.

BRIEF DESCRIPTION OF THE INVENTION

In accordance with the present invention, a boring type continuous mining machine is provided with a plurality of boring heads having coplanar axes of rotation parallel to the longitudinal axis of the machine. The boring heads are staggered longitudinally of the mining machine to enable relatively close lateral spacing of the boring heads. In the illustrated embodiment, each boring head includes a primary cutter head adapted to cut a generally circular bore in the mine face, and a pair of contour cutters carred by the primary cutter head for rotation therewith, the contour cutters also being rotatable about axes parallel to and spaced from the rotational axis of the associated primary cutter head. Each contour cutter has a pinion gear associated therewith which engages a fixed spur gear concentric with the rotational axis of the assoicated primary cutting head so as to effect predetermined rotation of the contour cutters in relation to rotation of the primary cutter. Each contour cutter has eccentic cutter teeth or bits thereon which, during each rotation of the contour cutter about its own rotational axis, cut a contour area radially outside but intersecting the circular bore cut by the associated primary cutter. The pinion gears and fixed spur gear are selected so that during each complete revolution of a contour cutter about the rotational axis of its associated primary cutter head, the contour cutter rotates through four revolutions, thus forming four circumferentially equidistantly spaced radial contour cuts about the axis of the primary cutter. By predetermined placement of the cutter teeth on the contour cutters, and by selective positioning of the contour cutters relative to the axis of the primary cutter, a substantially square shaped bore contour can be obtained by each boring head. Relatively close placement of the staggered boring heads will thus substantially eliminate the formation of cusps. The boring heads are mounted on a support block in a manner to isolate thrust loads on the boring heads from the boring head drive trains.

One of the primary objects of the present invention is to provide a novel contour boring head for a boring type continuous mining machine which is relatively simple in construction and which provides a desired generally rectangular bore hole without auxiliary trim chains and the like.

Another object of the present invention is to provide a continuous mining machine of the boring type employing a plurality of novel contour boring heads which are mounted on the machine in a manner allowing independent drive of the various boring heads without interference therebetween, thus eliminating the need for timed rotational connection means between adjacent boring heads as has heretofore been required.

Another object of the present invention is to provide an arrangement for mounting a plurality of boring heads on a continuous boring type mining mechanism such that the reaction forces acting on the boring heads generally normal to their working faces are transferred directly to the machine frame rather than acting on the gear train drives for the respective boring heads.

A feature of the boring heads in accordance with the present invention lies in the ability of the boring heads to be moved generally radially or laterally from their respective primary working axes as well as being tiltable while disposed within the cut bore hole so as to facilitate removal of the mining machine from the working face of the mine.

Further objects and advantages of the present invention, together with the organization and manner of operation thereof, will become apparent from the following detailed description of the invention when taken in conjunction with the accompanying drawings wherein like reference numerals designate like elements throughout the several views, and wherein:

DETAILED DESCRIPTION OF THE PREFERRED EMBODIMENTS

Figure 1:
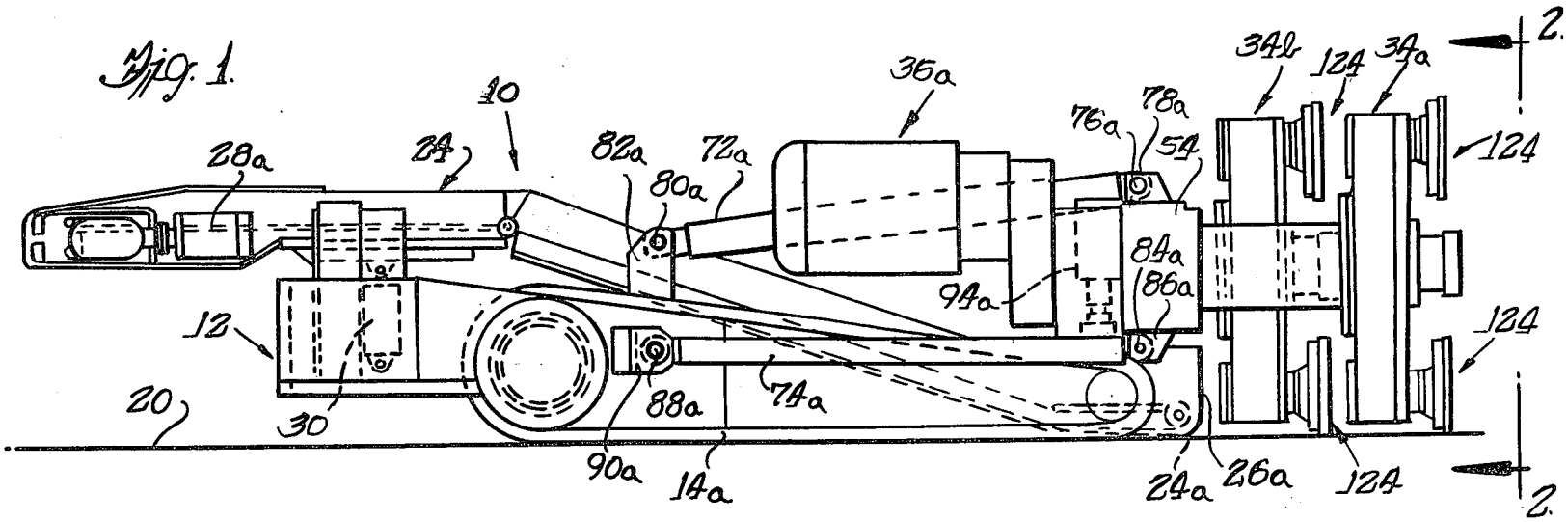
FIG. 1 is a side elevational view of a continuous mining machine constructed in accordance with one embodiment of the present invention.
Figure 2:
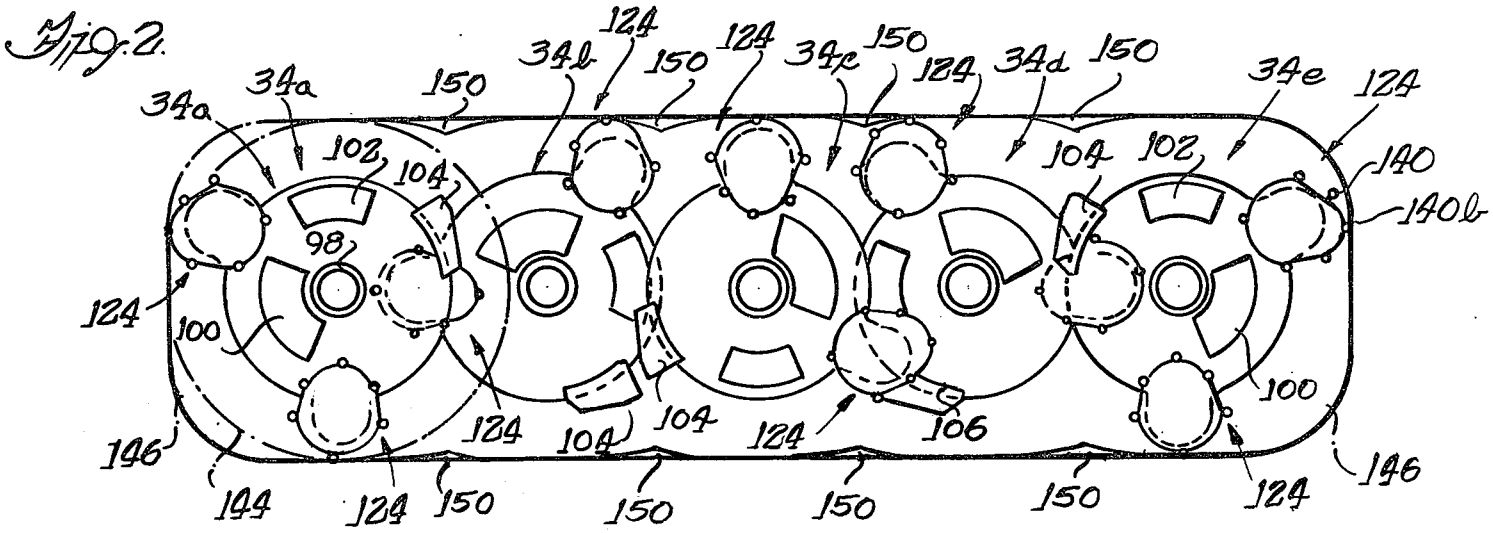
FIG. 2 is a front elevational view of the mining machine of FIG. 1, taken substantially along line 2—2 of FIG. 1 and looking in the direction of the arrows.
Figure 3:
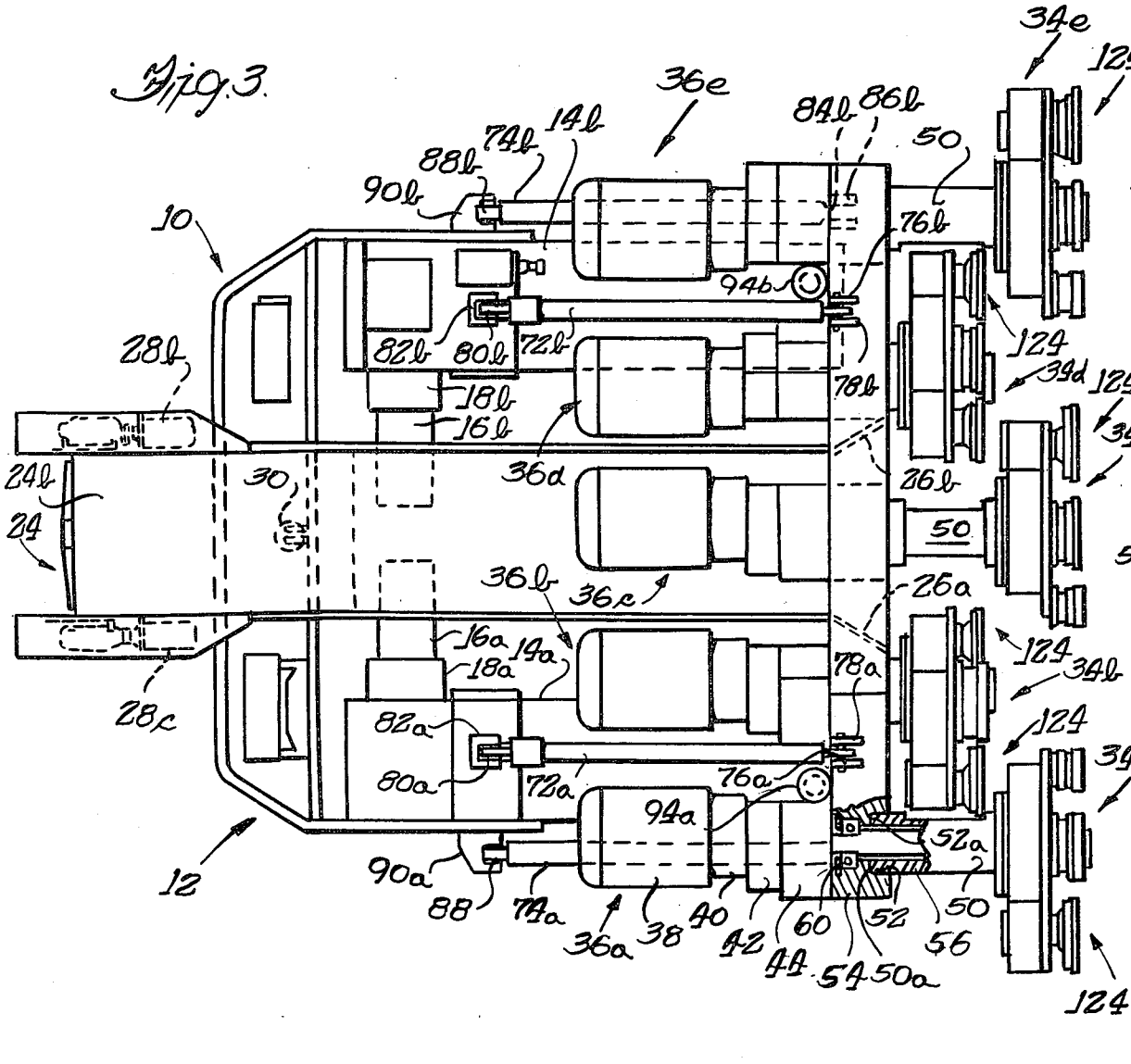
FIG. 3 is a plan view of the mining machine of FIG. 1.

Referring now to the drawings, and in particular to FIGS. 1-3, the present invention is illustrated, by way of example, embodied in a boring type continuous mining machine indicated generally at 10. The mining machine 10 includes a mobile primary base frame, indicated generally at 12, which comprises the main machine frame and is mounted on parallel endless treads 14*a* and 14*b* of conventional design. The treads 14*a,b* have operative association with respective tram motors 16*a,b* and transmissions 18*a,b* which are operative to enable operator controlled tramming movement of the mining machine along a mine floor or other surface 20 in the longitudinal direction of the mining machine or in a turning movement through differential movement of the treads as is known. The mining machine 10 finds particular application in continuous mining of coal, gypsum, salt, potash and other materials as conventionally mined by boring type mining machines.

An endless conveyor, indicated generally at 24, is disposed centrally of and extends longitudinally of the main frame 12. The conveyor 24 defines a forward lower receiving end 24*a* disposed in relatively close proximity to the mine floor surface 20 for receiving mined cuttings or particulate materials. To facilitate feeding of mined material onto the lower end 26*a* of the conveyor during forward tramming movement of the mining machine, forwardly diverging trough or cuttings confining plates 26*a,b* are mounted on the opposite lateral sides of the conveyor trough adjacent the forward end thereof in a known manner. The conveyor 24 terminates at the rearward end of the mining machine in a discharge end 24*b* from which the conveyed material is discharged onto hauler cars or other suitable conveying means. A pair of conveyor drive motors 28*a* and 28*b* of conventional design serve to drive the conveyor 24. A lift cylinder 30 operates between the main frame 12 and the conveyor 24 and is operative to raise and lower the discharge end of the conveyor in a known manner.

A suitable operator control station (not shown) of known design is provided on the mining machine 10 and has control devices enabling operator control of the various operating functions including the tramming treads 14*a,b* and conveyor 24. The various drive connections and control devices, per se, form no part of the present invention and need not be described in detail herein.

The base or main frame 12 has a relatively low-slung side profile and supports a plurality of substantially identical boring heads, indicated generally at 34*a–e*, at the forward end of the machine. In the illustrated embodiment, five boring heads are supported on the forward end of the mining machine for rotation about axes which lie in generally horizontal coplanar spaced relation parallel to the longitudinal axis of the mining machine. The boring heads 34*a–e* are supported in staggered relation relative to the longitudinal axis of the mining machine so as to enable closer spacing of the axes of the boring heads and facilitate independent driving rotation of the respective boring heads without need for interconnection between the respective boring heads through timing gears or other means in order to prevent physical interference between adjacent boring heads as has heretofore been required.

Each of the boring heads 34*a–e* has drive means, indicated generally at 36*a–e*, respectively, operatively associated therewith for enabling selective independent driving rotation of the boring heads as they are advanced into the face of a mine seam during mining. In the illustrated embodiment, each drive means 36*a–e* includes a suitable electric drive motor 38, a clutch 40, a reducer gear box 42 and a planetary transmission 44, all of which are of known design and cooperate to form a drive train enabling operator control of the speed and rotation of the respective boring heads.

Figure 5:
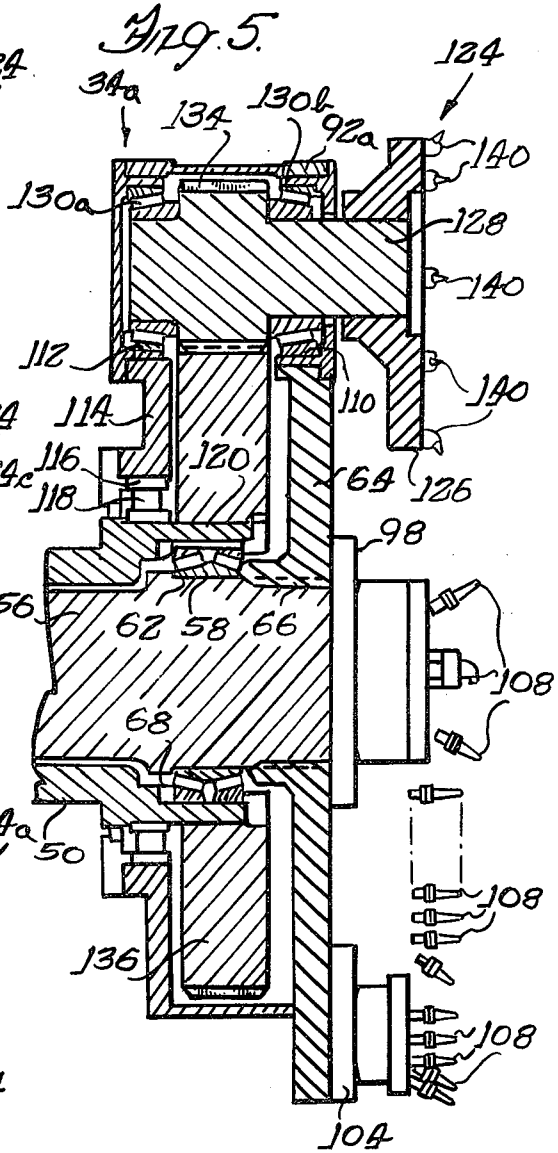
FIG. 5 is a fragmentary sectional view of the boring head of FIG. 4, taken substantially along line 5—5 of FIG. 4 and looking in the direction of the arrows.

In accordance with one feature of the present invention, the drive means 36*a–e* for the associated boring heads 34*a–e* are supported so as to be isolated from reaction thrust forces acting on the boring heads in the direction of their rotational axes, thereby prolonging the life of the various drive components. With reference to FIGS. 3 and 5, and taking cutter head 34*a* as exemplifying the manner in which all of the cutter heads are mounted on the forward end of the mining machine, each boring head includes an annular structural hub 50 having a rearward end 50*a* fixedly supported within a suitable bore 52 in a rectangular boring head support block 54 which extends transversely to and substantially the full width of the mining machine. The rearward end of the structural hub 50 abuts an annular shoulder surface 52*a* at the base of the associated cylindrical bore 52 so that any axial thrust forces acting on the structural hub 50 are transferred directly to the boring head support block 54.

Each boring head 34*a–e* also includes a drive shaft 56 which is coupled at its rearward end to the associated planetary transmission 44 for driving rotation therewith. The drive shafts 56 are rotatably supported within their respective hubs 50 by forward thrust bearings 58 and rearward radial bearings 60. The inner race of each thrust bearing 58 abuts an annular shoulder surface 62 formed on the associated drive shaft 56 and is held thereagainst by a cutter support plate 64 which is fixed on the forward end of the drive shaft through a spline connection 66. The outer race of each thrust bearing 58 is held against an annular shoulder surface 68 by a retainer ring 70. In this manner, reaction thrust forces acting on the boring heads are transmitted to the associated hubs 50 which, in turn, transmit the forces to the boring head support block 54. The thrust forces acting on the boring heads are thus isolated from the respective driven means 36*a–e*.

The support block 54 is connected to and supported by laterally spaced upper and lower pairs of strut, or thrust members 72*a,b* and 74*a,b* through which the thrust forces acting on the support block 54 are transferred directly to the main frame 12 of the mining machine. With reference to FIGS. 1 and 3, the thrust members 72*a,b* are pivotally connected at their forward ends through thrust pins 76*a,b* to brackets 78*a* and 78*b*, respectively, formed integral with and projecting upwardly from the support block 54. The rearward ends of the thrust members 72*a,b* are pivotally connected through thrust pins 80*a,b* to upstanding brackets 82*a,b* fixed to the base frame 12 such that the thrust members 72*a,b* are symmetrical relative to the longitudinal axis of the mining machine. The thrust members 72*a,b* are of the telescoping type to enable the operator to selectively change one or both of their lengths.

The trust members 74*a,b* are similarly mounted in symmetrical relation to the longitudinal axis of the mining machine and have their forward ends pivotally connected through thrust pins 84*a,b* to depending brackets 86*a,b* formed integral with the support block 54. The rearward ends of the thrust members 74*a,b* are pivotally connected through thrust pins 88*a,b* to brackets 90*a,b*, respectively, which are fixed to the main machine frame 12. The thrust members 74*a,b* are preferably adjustable to predetermined lengths but remain generally fixed in length after initial setting.

A pair of laterally spaced upstanding actuating cylinders 94*a* and 94*b* are operatively interconnected between the main frame 12 and the support block 54 and have extendable piston rods selectively operable to enable raising and lowering of the boring head support block 54 and associated boring heads 34*a–e* relative to the mine floor surface 20. It will be appreciated that with the actuating cylinders 94*a,b* maintaining the support block 54 and associated boring heads in a predetermined elevational position, extension of the upper thrust members 72*a,b* will effect pivotal tilting of the support block and boring heads about a pivot axis defined by the axially aligned thrust pins 84*a,b*. Differential extension or retraction of the actuating cylinders 94*a,b* enables selective pivotal tilting of the support block 54 about an axis generally central to the support block and parallel to the longitudinal axis of the mining machine. This pivotal tilting of the boring head facilitates removal of the boring heads from a cut or bored seam. It will be understood that means such as side thrust shoes (not shown) are provided on the main frame to act against the support block 54 so as to prevent lateral movement when subjected to side thrust forces, as is known.

In accordance with another feature of the present invention, each of the boring heads 34*a–e* is adapted to form a substantially rectangular bore profile when advanced against a mine face during rotation. By providing a plurality of longitudinally staggered and relatively close laterally spaced boring heads 34*a–e*, and with each boring head being adapted to form a substantially rectangular bore contour, cusps as have heretofore been formed between adjacent boring heads in multiple boring head mining machines are virtually eliminated or are so reduced in size that they do not inhibit progressive tramming of the mining machine into the bore being cut. While a single boring head will be described as representative of the boring heads, it will be understood that the two boring heads 34*d* and 34*e* to the right of the center boring head, as considered in FIG. 2, have their cutter bit positions reversed from the bit positions for boring heads 34*a–c* so that the heads 34*d* and *e* may be rotated in opposite directions to heads 34*a–c*. The boring heads thus urge the cuttings toward the center conveyor on the mining machine in a conventional manner.

Figure 4:
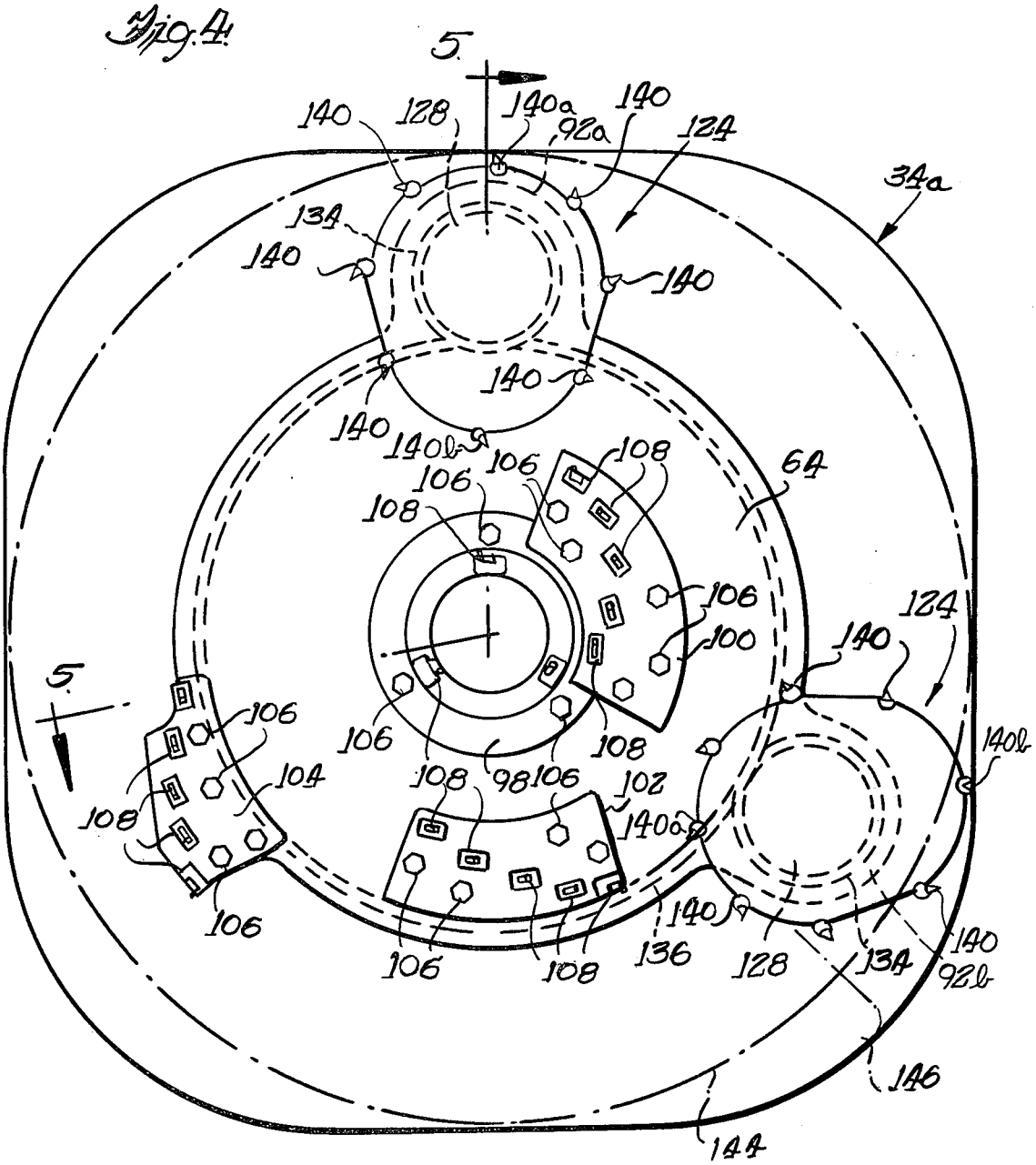
FIG. 4 is a front elevational view, on an enlarged scale, of a boring head of the type employed on the mining machine of FIG. 1.

Referring to FIGS. 4 and 5, taken in conjunction with FIGS. 2 and 3, and considering boring head 34*a* are being representative of the boring heads, each boring head 34*a–e* includes a primary cutter head and at least one contour cutter. The primary cutter includes the aforementioned cutter support plate 64 which is fixed on the forward end of the associated drive shaft 56 in substantially normal relation thereto through the spline connection 66. Each drive shaft 56 defines the longitudinal axis of its associated boring head and also defines a first rotational axis about which the primary cutter head rotates. In the illustrated embodiment, each cutter head support plate 64 has a plurality of cutter tooth mounting plates, such as indicated at 98, 100, 102, 104, attached to the forward face thereof through suitable mounting screws 106, each of the tooth mounting plates having a plurality of cutter bits or teeth 108 mounted thereon such that the cutter bits or teeth on the primary cutter head lie in a common plane transverse to the axis of the associated drive shaft 56. The various cutter tooth mounting plates 98, 100, 102 and 104 and their associated cutter bits or teeth 108 are positioned on the face of the primary cutter head 92 such that rotation of the primary cutter head while advancing it into the mine face will cut a generally cylindrical or circular bore hole.

Referring particularly to FIGS. 4 and 5, the cutter support plate 64 of each primary cutter head is generally circular in elevational profile except for a radial projection which underlies and provides support for the cutter tooth mounting plate 104 and except for generally semi-circular radial projections or extensions 64*a* and 64*b* which are arcuately spaced about the axis of the cutter support plate 64 by approximately 120° both from each other and from a radial line passing generally through the geometric center of the tooth mounting plate 104. Each of the radial projections 64*a* and 64*b* has a circular bore 110 formed centrally therethrough in axial alignment with a similar circular bore 112 formed in a housing member 114 which is fixed to and forms a part of the primary cutter head. As best illustrated in FIG. 5, the housing member 114 has a cylindrical bore 116 formed generally centrally therethrough which receives a suitable annular bearing 118 the inner race of which is mounted on a cylindrical surface 120 formed on the outer end of the structural hub 50. In this manner, the hub 50 assists in supporting the housing 114 but enables relative rotation therebetween.

The housing member 114 cooperates with the cutter support plate 64 of the primary cutter head to support a plurality of contour cutters, each of which is indicated generally at 124. In the illustrated embodiment, two contour cutters 124 are carried by each of the primary cutter heads in predetermined arcuate spaced relation about the axis of the associated boring head drive shaft 56. Each of the contour cutters 124 has a contour cutter plate 126 which, as illustrated in FIG. 4, has a generally oval plan or profile configuration and is mounted on a support shaft 128 such that the support shaft is normal to the contour cutter plate and is affixed thereto eccentrically to the geometric center of the contour cutter plate. Each support shaft 128 and its associated contour cutter plate 126 is rotatably supported within the associated aligned bores 110 and 112 through annular bearings **130*a* and 130*b*. Each support shaft 128 defines a second rotational axis about which the corresponding contour cutter plate 126 is rotatable so as to enable rotation of the contour cutters about their respective rotational axes as they simultaneously rotate about the rotational axis 56** of the primary cutter head.

To effect predetermined rotation of the contour cutters 124 about their rotational axes 128 during rotation of the contour cutters with the corresponding primary cutter head about the axis of the associated drive shaft 56, timing gear means are provided between the contour cutters and primary cutter head. The timing gear means includes a pinion gear 134 formed on each of the contour cutter support shafts 128 for intermeshing relation with external peripheral teeth formed on a spur gear 136 which is fixed on the cylindrical surface 120 of the structural hub 50 concentric with the axis of drive shaft 56. The fixed gear 136 is housed within an annular space established between the primary cutter support plate 64 and the housing member 114.

Each of the contour cutter plates 126 has a plurality of cutter teeth or bits 140 mounted thereon in eccentric relation to the corresponding axis of rotation 128. In the illustrated embodiment, the outer tips of the cutter teeth 140 on the contour cutters lie in a common plane parallel to but spaced rearwardly from the plane containing the outermost tips of the cutters 108 carried by the primary cutter support plate 64.

With reference to FIG. 4, the two contour cutters 124 carried by each of the boring heads **34*a–e* are arcuately spaced approximately 120° about the axes of rotation 56 of the boring heads, this angle being the included angle between radial lines from the center of drive shaft 56 passing through the axes of rotation 128 of the respective contour cutters. As will become more apparent hereinbelow, each boring head could include a single contour cutter 124** to accomplish the desired profile cutting in cooperation with the associated primary cutter head, although two contour cutters are desired to provide greater efficiency and cutting speed.

In the illustrated embodiment, the pinion gears 134 and fixed gear 136 are selected so that each of the contour cutters 124 rotates through four complete revolutions during each full revolution about the fixed gear. The cutter teeth or bits 140 on the contour cutters 124 are located such that as the contour cutters rotate about their respective rotational axes 128 simultaneously with rotation about the axis of the drive shaft 56, the contour cutter tooth or bit **140*a* located closest to its rotational axis 128 will cut an annular area radially outwardly from and concentric to but intersecting the circular bore cut by the primary cutter head, such as indicated by the phantom circular bore or profile line 144 in FIG. 4. The contour cutting tooth on each profile cutter 124 located the farthest eccentric distance from the corresponding rotation axis 128, such as indicated at 140*b*, will follow a path radially outwardly from the cylindrical bore formed by both the cutter teeth 108 on the primary cutter head and the corresponding contour cutter tooth 140*a* once during each revolution of the contour cutter 124 so as to cut a profile area as indicated by the line 146** in FIG. 4.

The two profile cutters 124 on each boring head 34a–e are located such that during rotation of the contour cutters a full revolution about the rotational axis 56 of the primary cutter head, each profile cutter will duplicate or pass through the same area traversed by the other profile cutter. The profile cutters 124 are also rotationally positioned relative to the fixed gear 136 so that each of the profile cutters cuts a radial outward profile area 146 as its passes through each 90° quadrant of a full revolution of the boring head. In this manner, and by proper initial setting or positioning of the boring heads **34*a–e* relative to the axis of the mining machine 10, substantially rectangular profile bore holes will be formed by each of the boring heads, with the corner areas 146 of each rectangular profile bore being disposed substantially 45° from vertical as shown in FIG. 4. By mounting the boring heads 34*a–e* in relatively closely spaced lateral relation, as shown in FIG. 2, the generally rectangular bore holes formed by the boring heads overlap so as to form an elongated rectangular seam or bore opening in the face of a mine being cut, leaving substantially minimal cusps between adjacent cutting heads, as indicated by the areas 150** in FIG. 2. Similarly, the corners of the resulting rectangular profile bore are substantially square.

By providing two contour cutter heads 124 on each boring head and positioning the contour cutters at approximately 120° from each other about the rotational axis of the boring head, it will be appreciated that the operator can rotate the various cutter heads to similar desired rotational positions, such as with the profile cutters 124 being positioned at upward positions approximately 60° from vertical, wherefter the operator can tilt the cutter heads forwardly and downwardly about the axis of the thrust pins **84*a,b*** to space the contour cutter teeth from the wall of the bore or seam being mined, and thus facilitate rearward movement of the mining machine.

Thus, in accordance with the embodiment illustrated in FIGS. 1–5, a boring type continuous mining machine is provided having boring heads which are adapted to both individually and in cooperative combination form generally rectangular shaped bore holes whereby to substantially eliminate the need for trim chains and trim bars as have heretofore been required to remove cusps and form corner ventilation areas in the bore holes. Additionally, by mounting the various boring heads **34*a–e* on a transverse boring head support block 54 as aforedescribed, the axial thrust forces acting on the boring heads as they are advanced into a mine face or seam during a mixing operation are substantially isolated from their associated drive means 36***a–e*, with such forces being transferred directly to the main frame of the mining machine through the thrust or strut members 72*a,b* and 74*a,b*.

Figure 6:
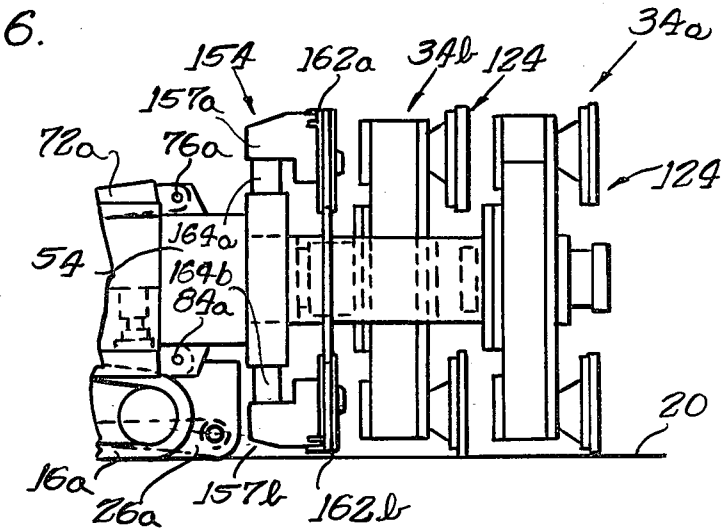
FIG. 6 is a fragmentary elevational view of an alternative mining machine in accordance with the present invention which employs trim chains in conjunction with the boring heads.
Figure 7:
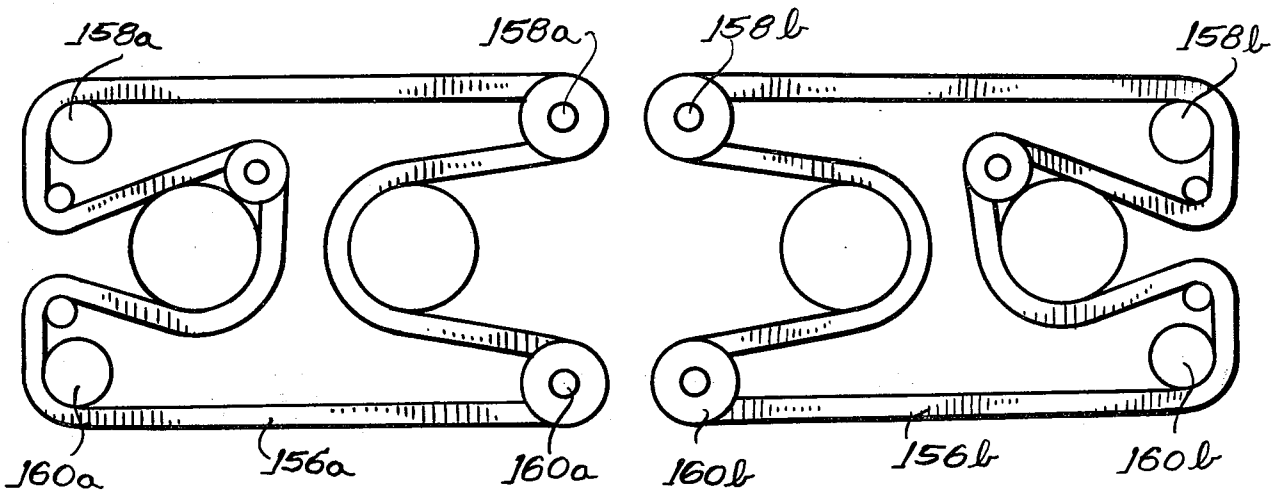
FIG. 7 schematically shows the placement of the trim chains as viewed substantially along line 7—7 of FIG. 6.

FIGS. 6 and 7 illustrate an alternative embodiment of a boring type continuous mining machine in accordance with the present invention which also employs a trim chain assembly, indicated generally at 154. When employing a trim chain assembly 154, the support shafts and support hubs for the respective boring heads 34*a–e* are made of greater length so that the boring heads are spaced forwardly from the trim chain assembly 154.

The trim chain assembly 154 may be of generally known design and includes a pair of endless trim chains 156*a* and 156*b* which may be of substantially identical length and are supported by a support structure including upper and lower supports 157*a,b* in symmetrical fashion relative to a vertical plane containing the longitudinal axis of the mining machine 10. In the illustrated embodiment, the trim chains 156*a* and 156*b* are guided about respective upper corner sprockets, indicated schematically at 158*a* and 158*b* in FIG. 7, and lower corner sprockets 160*a* and 160*b* so as to establish upper and lower generally horizontal reaches for the respective trim chaines 156*a,b*. The trim chains are also guided about intermediate sprockets at least one of which is preferably a tension idler sprocket for maintaining uniform tension on the trim chains as is known. The trim chains 156*a,b* are also guided about suitable drive sprockets which are preferably independently rotatably driven for effecting movement of the trim chains, the drive means for the respective chains being adapted to move the lower horizontal reaches of the chains in directions toward the center axis of the mining machine to assist in moving cuttings to the forward end 24*a* of the conveyor 24. Upper and lower horizontal trim bars, such as shown at 162*a* and 162*b* in FIG. 6, may be mounted on the support structures 157*a,b* for guiding the trim chains and for cutting any remaining cusps between the adjacent cutter heads 34*a–e*. Suitable hydraulic jacks, such as shown at 164*a* and 164*b*, are preferably provided to enable height adjustment of the trim bars, as is known.

While preferred embodiments of the present invention have been illustrated and described, it will be understood that changes and modifications may be made therein without departing from the invention in its broader aspects. Various features of the invention are defined in the following claims.

What is claimed is:

1. A rotary boring head for use in a continuous boring operation or the like comprising:

a primary cutter head having a longitudinal axis defining a first rotational axis and being operative to rotate and cut a bore of predetermined transverse cross-sectional configuration in a mine face or the like when advanced thereagainst while rotating about said first rotational axis, at least one contour cutter carried by said primary cutter head about said first rotational axis as said primary cutter head rotates, said contour cutter being rotatable about a second rotational axis parallel to and spaced from said first rotational axis and in predetermined timed relation to the rotation of said primary cutter head, said contour cutter having at least one cutter tooth thereon operative to cut selected circumferentially spaced areas radially outwardly of the bore cut by said primary cutter head during said rotation of said primary cutter head and said contour cutter in said predetermined timed relation so as to enlarge said bore and give it a cross-sectional shape approximating a square, and means for rotating said primary cutter head and said contour cutter in said predetermined timed relation.

2. A boring head as defined in claim 1 wherein said contour cutter is supported by said primary cutter head such that the area cut by said contour cutter intersects the bore cut by said primary cutter head in at least one cutting position of said contour cutter.

3. A boring head as defined in claim 1 wherein said contour cutter is supported by said primary cutter head such that said second rotational axis passes through a circular path concentric with said first rotational axis during rotation of said primary cutter head about said first rotational axis.

4. A boring head as defined in claim 3 wherein said primary cutter head includes cutter teeth adapted to cut a generally circular bore.

5. A boring head as defined in claim 3 wherein said contour cutter includes a cutter support plate lying in a plane normal to said second rotational axis and carrying said at least one cutter tooth thereon eccentric to said second rotational axis.

6. A boring head as defined in claim 5 wherein said second rotational axis is defined by a support shaft rotatably mounted on said primary cutter head, said cutter support plate having said support shaft connected in normal relation thereto at a point eccentric to the geometric center of said cutter support plate.

7. A boring head as defined in claim 3 wherein said contour cutter includes a plurality of cutter teeth thereon at least one of which is adapted to cut an annular area radially outwardly of and concentric with the circular bore cut by said primary cutter head, at least one other of said contour cutter teeth being adapted to cut an area radially outwardly of and intersecting said annular area.

8. A boring head as defined in claim 1 including two of said contour cutters carried by said primary cutter in arcuately spaced relation about said first rotational axis.

9. A boring head as defined in claim 1 wherein said means for effecting predetermined rotation of said contour cutter about said second rotational axis includes timing gear means operative to effect predetermined rotation of said contour cutter about said second rotational axis for each full revolution of said primary cutter about said first rotational axis.

10. A boring head as defined in claim 9 wherein said gear means includes a pinion gear fixed to said contour cutter, and a fixed gear concentric with said first axis of rotation, said pinion gear having cooperative relation with said fixed gear such that rotation of said primary cutter head relative to said fixed gear effects predetermined rotation of said contour cutter about said second rotational axis.

11. A boring head as defined in claim 10 including a plurality of substantially identical contour cutters carried by said primary cutter, each of said contour cutters being rotatable about a respective second rotational axis spaced from and parallel to said first rotational axis and having a pinion gear cooperative with said fixed gear so as to effect predetermined rotation of said contour cutters about their said second rotational axes upon rotation of said primary cutter about said first rotational axis.

12. A boring head as defined in claim 11 wherein each of said contour cutters has at least one cutter tooth thereon adapted to cut an area radially outwardly of and intersecting the bore cut by said primary cutter, said contour cutters being arcuately positioned about said first rotational axis so that the path travelled by the cutter teeth on each of said contour cutters duplicates the path travelled by the other contour cutters.

13. A boring head as defined in claim 12 including two of said contour cutters carried by said primary cutter, said two contour cutters being arcuately spaced about said first rotational axis and said pinion and fixed gears being selected so that said contour cutters cut an area radially outwardly of the bore cut by said primary cutter head at approximately each 90 degree arcuate progression of said contour cutters about said first rotational axis.

14. A boring head as defined in claim 13 wherein said pinion gears each have a 1:4 gear ratio with said fixed gear.

15. A boring head as defined in claim 10 wherein aid primary cutter head includes a drive shaft defining said first rotational axis, and including an annular hub coaxial with said drive shaft and adapted to be maintained in fixed relation during rotation of said primary cutter head, said fixed gear being fixedly mounted on said hub.

16. In a boring type mining machine having at least one boring head defining a first rotational axis, means for rotating said boring head about said first rotational axis, and means for advancing the machine so as to engage said boring head against a mine face, said boring head having primary cutter teeth adapted to cut a generally circular bore in the mine face when advanced thereagainst; the improvement wherein said boring head includes at least one contour cutter carried by said boring head about said first rotational axis as said boring head rotates, said contour cutter being rotatable about a second rotational axis parallel to and spaced from said first rotational axis and in predetermined timed relation to the rotation of said primary cutter head and carrying at least one cutter bit adapted to cut selected circumferentially spaced areas radially outwardly of said circular bore during rotation of said contour cutter and said boring head in said predetermined relation as said boring head is advanced against said mine face so as to enlarge said circular bore and give it a cross-sectional shape approximating a square, and means for rotating said contour cutter and said boring head in predetermined timed relation.

17. A mining machine as defined in claim 16 including a plurality of said boring heads each of which is rotatable about a respective first rotational axis, said first rotational axes being coplanar and parallel to the longitudinal axis of the mining machine.

18. A mining machine as defined in claim 17 wherein each of said boring heads has individual drive means associated therewith adapted to effect rotation about its respective first rotational axis.

19. A mining machine as defined in claim 18 including a main machine frame, and means supporting said boring heads on said main frame in a manner to isolate thrust forces from acting on said drive means.

20. A mining machine as defined in claim 19 wherein said support means includes a generally transverse support block, each of said boring heads being supported by said support block so that thrust forces acting on said boring heads are transferred to said support block, and thrust members interconnecting said support block to said main frame.

21. A mining machine as defined in claim 20 wherein selected ones of said thrust members are operable to effect tilting of said boring heads about a pivot axis generally transverse to said machine.

22. A mining machine as defined in claim 17 wherein said boring heads are mounted in alternate longitudinal staggered relation, and including independent rotational drive means operatively associated with each of said boring heads.

23. A mining machine as defined in claim 22 including trim chain means supported transversely of said machine and defining reaches adapted to cut any cusps formed between adjacent boring heads.

24. A mining machine as defined in claim 23 wherein said trim chain means includes a pair of trim chains mounted in symmetrical relation to the longitudinal axis of the machine and operable to move cuttings toward the longitudinal axis of the machine.

25. A mining machine as defined in claim 24 including conveyor means disposed longitudinally of the machine.

26. A mining machine as defined in claim 16 wherein said contour cutter is supported by said primary cutter head such that said second rotational axis passes through a circular path concentric with said first rotational axis during rotation of said primary cutter head about said first rotational axis.

27. A mining machine as defined in claim 16 wherein said contour cutter is supported by said primary cutter head such that the area cut by said contour cutter intersects the bore cut by said primary cutter head in at least one cutting position of said contour cutter.

28. A mining machine as defined in claim 26 wherein said contour cutter includes a plurality of cutter teeth thereon at least one of which is adapted to cut an annular area radially outwardly of and concentric with the circular bore cut by said primary cutter head, at least one other of said contour cutter teeth being adapted to cut an area radially outwardly of and intersecting said annular area.

29. A mining machine as defined in claim 16 including two of said contour cutters carried by said primary cutter in arcuately spaced relation about said first rotational axis.

30. A mining machine as defined in claim 16 wherein said means for effecting predetermined rotation of said contour cutter about said second rotational axis includes timing gear means operative to effect predetermined rotation of said contour cutter about said second rotational axis for each full revolution of said primaary cutter about said first rotational axis.

31. A mining machine as defined in claim 30 wherein said gear means includes a pinion gear fixed to said contour cutter, and a fixed gear concentric with said first axis of rotation, said pinion gear having cooperative relation with said fixed gear such that rotation of said primary cutter head relative to said fixed gear effects predetermined rotation of said contour cutter about said second rotational axis.

32. In a boring type mining machine, the combination comprising:

a main base frame having means for advancing said frame along a predetermined path, a plurality of boring heads, each defining an axis of rotation and having a cutting face, drive means operatively associated with said boring heads for effecting rotation thereof about their axis of rotation, and tiltable support means operatively associated with said main frame and supporting said boring heads and said drive means in a manner such that reaction forces acting substantially normal to said boring heads during mining are transferred to said main frame and isolated from said drive means, said support means including a generally transverse support block, said boring heads and said drive means being supported on said support block such that thrust forces acting on said boring heads are transferred to said support block, and a pair of thrust members connected at opposite ends to said main frame and said support block, selected ones of said thrust members being operable to effect tilting of said support block, and thereby said boring heads, about a pivot axis generally transverse to said machine.

* * * * *